US008795607B2

(12) United States Patent
Kurowski et al.

(10) Patent No.: US 8,795,607 B2
(45) Date of Patent: Aug. 5, 2014

(54) FLUID METERING CONTAINER

(75) Inventors: Dirk Kurowski, Gevelsberg (DE); Berthold Lange, Werne (DE); Dirk Osterloh, Unna (DE)

(73) Assignee: Boehringer Ingelheim Microparts GmbH, Dortmund (DE)

( * ) Notice: Subject to any disclaimer, the term of this patent is extended or adjusted under 35 U.S.C. 154(b) by 491 days.

(21) Appl. No.: 12/999,323

(22) PCT Filed: Jun. 2, 2009

(86) PCT No.: PCT/EP2009/003907

§ 371 (c)(1),
(2), (4) Date: Dec. 16, 2010

(87) PCT Pub. No.: WO2009/152952

PCT Pub. Date: Dec. 23, 2009

(65) Prior Publication Data

US 2011/0186466 A1 Aug. 4, 2011

(30) Foreign Application Priority Data

Jun. 19, 2008 (EP) ..... 08011106

(51) Int. Cl.

*B65D 17/30* (2006.01)
*B65D 17/42* (2006.01)
*B01L 3/00* (2006.01)

(52) U.S. Cl.

CPC ..... *B01L 3/502715* (2013.01); *B01L 3/505* (2013.01); *B01L 2200/027* (2013.01); *B01L 2200/0605* (2013.01); *B01L 2200/16* (2013.01); *B01L 2200/0684* (2013.01); *B01L 2300/044* (2013.01); *B01L 2300/123* (2013.01); *B01L 2300/047* (2013.01); *B01L 2300/0672* (2013.01); *B01L 2300/0809* (2013.01); *B01L 2300/14* (2013.01); *B01L 2300/0887* (2013.01); *B01L 2400/0481* (2013.01)

USPC ..... 422/550; 422/503; 422/504; 422/551; 422/294; 422/944; 206/222; 206/532; 206/524.6; 137/68.23; 137/68.25

(58) Field of Classification Search

None
See application file for complete search history.

(56) References Cited

U.S. PATENT DOCUMENTS 3,689,224 A 9/1972 Agnew et al.
2003/0186456 A1 10/2003 Stroup (Continued)

FOREIGN PATENT DOCUMENTS

DE 10336850 A1 3/2005
DE 102006019101 A1 11/2006

(Continued)

OTHER PUBLICATIONS

Abstract in English of JPH09-175738, 1997.

(Continued)

*Primary Examiner* — Jill Warden
*Assistant Examiner* — Timothy G Kingan
(74) *Attorney, Agent, or Firm* — Michael P. Morris; Mary-Ellen M. Devlin

(57) ABSTRACT

The invention relates to a container (1) for a fluid for metering a reagent into a microfluidic system. The container comprises a chamber (4) and a first film (3) which seals off the chamber (4) so that the fluid is encapsulated in the chamber. Advantageously, the first film (3) is an aluminum sealing film. A second film (7) is sealingly arranged on the first film, for example by adhesive bonding of the film layers. The films differ in their tear strength such that when pressure is applied simultaneously to both films the first film tears while the second film deforms elastically and/or plastically. By tearing the first film a connection is produced between the container chamber and an inlet channel so that a fluid contained in the chamber flows into the microfluidic system.

19 Claims, 7 Drawing Sheets

(56) References Cited

U.S. PATENT DOCUMENTS

| | | | | |
|---|---|---|---|---|
| 2006/0245972 | A1 | 11/2006 | Osone et al. | |
| 2007/0224084 | A1 | 9/2007 | Holmes et al. | |
| 2007/0274869 | A1* | 11/2007 | Rannikko et al. | 422/99 |
| 2008/0152541 | A1 | 6/2008 | Mosticone et al. | |
| 2010/0308051 | A1* | 12/2010 | Weber | 220/266 |
| 2012/0214254 | A1* | 8/2012 | Schmidt et al. | 436/174 |

FOREIGN PATENT DOCUMENTS

| | | | |
|---|---|---|---|
| EP | 0583833 | A2 | 2/1994 |
| JP | H09-175738 | A | 7/1997 |
| WO | 2006008407 | A1 | 1/2006 |
| WO | 2006121510 | A2 | 11/2006 |
| WO | 2006132666 | A1 | 12/2006 |
| WO | 2007025773 | A2 | 3/2007 |

OTHER PUBLICATIONS

English language translation of the abstract for DE10336850, Thinxxs GmbH, date of publication: Mar. 10, 2005.

International Search Report, Form PCT/ISA/210, for corresponding PCT/EP2009/003907, date of mailing: Oct. 20, 2009.

* cited by examiner

FLUID METERING CONTAINER

The invention relates to a container for storing and metering fluids in microfluidic devices according to claim 1. The invention further relates to a blister strip and a microfluidic device. In addition, the invention relates to a medical analysis instrument, a process for producing a container, as well as a method of metering a fluid.

In microfluidic devices, often small amounts of liquid have to be metered in precise volumes. Examples of the liquids to be metered might be solvents, buffer solutions, nutrient solutions, reagents or combinations thereof. The microfluidic device is used in analysis mostly for analysing biological and/or chemical reactions. The core of the analysis device is a cartridge in which capillary channels and chambers are provided, the capillary effect or external forces ensuring that liquids which are to be investigated are transported. The capillary channels form a connection between an inlet region and an analysis region, while a network of channels ensures distribution of the sample liquids such as, in particular, urine, blood or blood plasma or other biological sample solutions.

The transportation ensures, for example, mixing of the sample fluid with reagents contained in the cartridge. In complex detection reactions or complex analyses it is necessary to meter a series of different solutions in precise volumes in a specific sequence. As the operator of an analysis device should be required to carry out operating procedures which are as simple as possible so as to rule out the risk of faulty operation, it is advantageous to couple the storage containers and the metering means with the cartridge.

As a result there is no need for the operator to carry out difficult handling of the sample fluids and his input is reduced to replacing the cartridges with an integrated metering mechanism in the analysis equipment.

The analysis equipment then performs all the other steps such as the controlled addition of solvents, the selection of a specific temperature, the mixing of solutions and the detection of physical or chemical changes in the sample liquid as a function of the particular biological or chemical reactions which have taken place. Automation of the operating process in the metering of liquids in the microfluidic cartridge can be achieved by integrating liquid containers into the cartridge, or by fluidically connecting containers that contain solutions or reagents to the cartridge. This connection may be carried out by later connection of a container or blister having a number of containers to a cassette or cartridge. After manufacture, the container or blister is placed on a cassette or cartridge or alternatively adhesively bonded or welded thereto.

Reagents can easily be packed into pouches, wells or recesses formed in a blister. In the production of the blister, depressions produced by thermoplastic deformation are typically formed in one plastics strip or a carrier film, the depressions are each filled with a desired solution or reagent and the filled blister pouch is sealed in fluid-tight manner by means of a covering film.

The cartridge and a blister strip constructed to fit the cartridge are then positioned relative to one another and/or joined together, such that a connection can be produced between the liquid-filled blister chambers and the microfluidic network on the cartridge.

To ensure that the blisters or the cartridge-blister cassette is suitable for storage, the liquid or solution in the blister chamber must be enclosed in a manner to prevent evaporation and leakage.

During the operation of the cartridge-blister cassette, the blister chambers are opened at certain points. This can be done, for example, by severing the blister film in the region of the chamber base so that liquid runs out through the severing point and then drips into an investigation chamber of the cartridge or is taken up by an inlet region, e.g. a channel opening of the cartridge.

From DE 38 00 036A1, containers and investigation devices of this kind are known, while it is provided according to this published application that a sealed liquid container or a blister chamber either be pierced from outside or that a cone tip be provided inside the container for the piercing operation. By pressing the chamber in using finger pressure, in the latter case, the tip of the piercing tool integrated in the chamber is pressed through a sealing film, as shown in FIG. 17 of DE 38 00 036A1, as a result of which the liquid enclosed in the blister chamber is able to flow away.

A similar container is disclosed in WO 2006/07982 A2, in which a dome-shaped container that can be pressed in contains a sharp spike inside it. The spike is arranged at the apex of the dome so that when the deformable dome is depressed the tip of the spike perforates a sealing film. In this way the liquid contained in the interior of the dome or chamber is able to pass through the perforation into a channel the inlet region of which extends towards the chamber.

Alternatively it may be envisaged that the sealing film can be torn open merely by the application of pressure to the exterior of the dome, without the use of a spike. A disadvantage of the prior art described is that the usable chamber volume is restricted by the spike arranged inside the chamber. To allow movement of the spike relative to the enclosed liquid in order to pierce the sealing film, the chamber is only about 75% full of liquid. Gas is enclosed in the residual volume, which may produce undesirable gas bubbles during the metering of the liquid, which lead to malfunction in capillary-operated cartridges.

Moreover, a chamber of this kind can only be deformed to a limited extent, namely only under certain conditions beyond the span of movement which is restricted by the piercing of the sealing film by the spike. Therefore, a chamber which is totally filled according to the prior art cannot be emptied.

Another disadvantage of the prior art is that the need to deform the chamber in order to move the piercing spike creates pressure in the chamber. This has the effect that when the sealing film is pierced, depending on the application of pressure and the movement of the spike, an indeterminate quantity of liquid is undesirably released abruptly.

One important requirement of a container is that the liquid in the container should pass into a microfluidic device in controlled manner through a defined interface. The formation of air bubbles as the liquid leaves a container should be prevented. The liquid must be pressure-free for the controlled transfer of the liquid to the device and particularly into fluidic microstructures.

Against the background of the prior art described, the problem is therefore to provide an improved container, a method of manufacturing this container, an improved blister strip having a container of this kind and an improved microfluidic device. A further problem is to provide improved metering from a container into a microfluidic cartridge.

In particular the problem is to achieve a substantially bubble-free filling microfluidic cartridge and to achieve controlled metering of liquid from a container into a microfluidic network.

To solve the problem it is envisaged that a container should be provided for a liquid for metering a reagent, said container comprising a chamber and a first film, the first film closing off the chamber in such a way that the liquid is encapsulated in the chamber. A second film is arranged sealingly against the first film. By this is meant that the second film is attached to the surface of the first film and abuts closely on the first film. The first film may be adhesively bonded or laminated all over or, alternatively, it may be that locally there is not a flat adhesive bond, so that the first and second films are not attached to one another in these local regions but lie closely against one another. The films are of different breaking strengths, such that when a pressure is applied simultaneously to both films the first tears while the second film deforms elastically and/or plastically.

By the breaking strength is meant the material property of the films in relation to the stretching introduced in conjunction with the thickness of the film and/or geometry of the film. The breaking strength includes both the material property of elastic limit or tearing strength, related to the cross-section of the material, the elongation at break and also the density of the material. Thus, for example, the first film may be a thin metal film, particularly an aluminium foil. Aluminium or aluminium alloys typically have an elongation at break of 30% to 50%, while with Al alloys the elongation at break is 5% to 10%. By contrast, the elongation at break of plastics is several hundred percent, e.g. 200% to 2000%, preferably 300% to 700% for TPE plastics. This makes it possible for the first film, which preferably consists of metal with an elongation at break of less than 30%, to tear with little elongation when pressure is applied, while the second, outer, elastic plastics film undergoes only an elastic and/or plastic deformation.

The film material for the second elastic film may be synthetic rubber, TPE (thermoplastic elastomer), silicon, viton or other elastic plastics or natural elastic materials.

As an alternative to the use of a metal foil, the first film may also consist of a preferably brittle plastics which has an elongation at break of less than 50%. Another alternative which might be considered is the use of a ceramic film material. When ceramic films or plastic films are used the material should be fluid tight in relation to the fluid enclosed in the capsule. This may be achieved for example by applying a diffusion- and fluid-tight coating on the interior of the chamber. A diffusion-proof or fluid-tight coating is obtained for example by coating the first film with a metal film or dense plastic film, e.g. by vapour deposition, sputtering, melting or electrolytic precipitation of a film on the foil.

The first film is from 5 microns to 100 microns thick, preferably from 15 microns to 60 microns thick.

The first film tears when pressure of a few Newtons is applied. In order to increase the tendency to tearing of the first film or to determine the tearing location, it is possible to provide a frangible point, e.g. a notch, in the first film in the region of the chamber. The notch reduces the cross-section of the film and at the same time the notch forms a tearing peak from which the fracture or tearing of the first film starts. A notch may be formed by various mechanical methods such as standing, embossing, scratching or other shaping methods and material-removing processes such as etching or laser or energy beam machining. The frangible point or notch forms a preferential breakage point in the first film.

The container chambers are produced by plastic deformation of a plastics sheet or plastic film. Alternatively, the chamber-forming material may consist of metal or a composite material made up of various components such as metal, especially aluminium, and a thermoplastic plastics. By preferably thermoplastic deformation, a plurality of depressions, particularly hemispherical chambers, are formed in the plate-shaped substrate and in this way a blister strip is produced.

The chambers or depressions are filled with a liquid, particularly a reagent, and then a fluid-tight first film is secured to the base of the blister, particularly by adhesive bonding or melting, so that the first film encloses the liquid in the chamber away from the environment.

The shape of the chambers or pouches is half-shaped, dome-shaped, ellipsoid or tub-shaped, such that the pouch shape can be compressed. In a preferred embodiment the material of the blister consists of one of the materials polypropylene, PVC, PCTFE or PVDC. In a particularly preferred embodiment the material consists of polypropylene and has a thickness of 20 microns to 300 microns, preferably 60 microns to 120 microns. The material of the chamber wall and the first film should be diffusion-proof against liquids and gases, so as to prevent liquid from escaping and gas from entering. Advantageously, the materials are selected so that the blister strips are suitable for storage and retain their function over a period of more than half a year.

Within this period or over a longer time span of a year or eighteen months, depending on the carrier material, the material of the base film and the adhesive bond, the loss of liquid from the blister pouches should be less than 5%, preferably less than 1%, measured by the amount of liquid or volume of liquid. With regard to the gas entry coefficient this should be such that in particular no oxygen enters, so as to prevent oxidation of the solutions or reagents during the storage periods.

The size of the chambers is advantageously such that the container chambers can hold at least 5 microliters of solution. Other sizes for the container volume are 10, 20, 50, 150, 250, 300, 500, 1000, 2000, 5000, 10000, 20000 and 50000 microliters of reagent volume or liquid volume, depending on the need for the particular liquid. If for example washing steps are required during the analysis, larger quantities of liquid are used.

Different sizes of reservoir or container may be present on one blister strip. The containers preferably have a flat planar base or the openings of the containers are located in a flat plane which is closed off by means of the first and second films and are formed by pouches which rise above the flat surface. Typically, the bodies have a cross-section at the base or bottom surface of 1 mm to 5 cm. The cross-sectional length is measured as a diagonal through the surface, this cross-sectional surface being obtained by a section parallel to the base or to the opening.

The height, in this case the length of the surface normals from the bottom to the dome of the pouch is preferably 200 microns to 800 microns. Typically, the container is completely full but it is also possible that only small amounts of a reagent will be needed, e.g. 50 microliters, so that there will be partial filling, e.g. 5%, 10%, 25%, 50% or 75% of the total volume of the container. Typically, a partially filled reservoir or a container contains at least 10 microliters, 50 microliters or at least 100 microliters, depending on the reagent which is to be administered.

In another step, at least one elastic second film is applied to the first film, e.g. by lamination or lining of the films.

In one embodiment of the invention, at least one other intermediate film is arranged between the first film and the second outer elastic film. The intermediate film has an opening, particularly a clearance hole. The hole is preferably directed towards the interior of the chamber. It is also possible to provide a plurality of holes in the intermediate film. Moreover, one or more channels with an inlet region in the region of the chambers may be provided in the intermediate film. Preferably, the channel or channels with the openings mentioned above are in fluidic contact, and in particular an opening of this kind forms the inlet region for one or more channels.

The intermediate film has a thickness of 50-500 microns; particularly 150-250 microns, and consists of a plastics material.

The through-opening or a similarly provided channel formed as a recess or indentation in the intermediate film is fluidically separated from the container chamber by the first film. When force is applied to the films, the film on the inside of the chamber tears and the partition wall formed by the film opens between the chamber and the channel. Alternatively it is possible for the opening described or the channel described to be fluidically connected to the chamber and for the sealing film to close off the opening or channel.

The channel furthermore comprises an outlet region. In a preferred embodiment of the invention the outlet region is formed by means of a second through flow opening in the at least one intermediate film. In the outer elastic second film there may also be an opening at the site of this second opening, so that fluid from a container enters the inlet region of the channel through the burst or torn first film and is conveyed through the channel into the outlet region of the channel. The container can thus be emptied through the channel in defined manner at a specific outlet opening.

In a preferred embodiment, the second opening of the channel is sealed off by the outer elastic film. In the region of the second opening and adjacent thereto the intermediate film and the second elastic film abut on one another without being attached. This can be achieved, for example, by the fact that there is no adhesion between the intermediate film and the second film in a flat, channel-shaped section. This adhesive-free region connects the opening in the intermediate film with another opening in the elastic film or in the carrier material which is offset by the length of this region. As the elastic film also lies closely on the intermediate film in the region where there is no adhesion, the liquid remains enclosed in spite of the burst first film.

If pressure is then applied to the liquid or solution, the liquid is forced through the opening in the intermediate film into the unattached region, whereby the elastic film is expanded in this region and a channel is formed to the outer opening in the outer second elastic film or in the carrier material (blister). Advantageously, the elastic film exerts a constricting effect on the flow, by its elastic restoring force, as a result of which the liquid flows homogeneously without turbulence in the elastic channel. The result of the homogeneously constricted flow is that bubble formation is avoided.

In one embodiment of the invention, the blister strip is combined with a microfluidic platform. The microfluidic platform is a plate-shaped substrate, preferably a plastics sheet, with a network of channels and capillary channels formed in the substrate. At least one capillary channel has an inlet region which can be fluidically connected to at least one container of the blister for the purpose of metering a liquid.

For this, outlet openings on the blister strip are brought into alignment with inlet regions on the microfluidic platform and the blister strip is attached to the microfluidic platform. This attachment may be carried out for example by adhesive bonding of blister strips to the platform or by placing them in mutual guides.

In a particularly preferred embodiment the device provided for a user comprises a cartridge or cassette unit with a microfluidic platform and a container or a series of containers. The microfluidic platform which comprises microfluidic channels for metering and transporting a liquid or reagent is directly connected to one or more containers in the manufacturing process. The microfluidic platform consists of a plate-shaped substrate in which the channels are formed. The channels are closed off outwardly by a covering film or a covering carrier made of plastics, preferably transparent plastics. Alternatively, the channels and other structures may also be formed by an intermediate film or sheet in which the microfluidic punched holes or cut-outs have been formed. The base of a channel or a structure is then formed by the flat carrier plate and the upper closure is formed by a cover film or cover plate.

Preferably, a double-sided adhesive film is used as the intermediate film which joins the carrier plate and cover plate together by its adhesive force. Advantageously, the cover plate has recesses, particularly depressions, which can accommodate a container. The base of the recess has a through-flow opening which empties into a microfluidic channel or another microfluidic structure such as an inlet region, a collecting region or a separating region, particularly a filter region or is fluidically connected to this structure.

By a fluidic connection is also meant, for example, a section that acts as a valve and provides a connection only under external forces, i.e. a section which implements a fluid-conveying function depending on actuating mechanisms or forces. A container is secured, particularly by adhesion, in the depression. The container is sealed by a first film which encapsulates a fluid in the container chamber.

The film is preferably made of aluminium and can be severed by the action of a tool such as a die. Advantageously, the first film, which can also be regarded as a container lid, is attached to the base of the depression by means of double-sided adhesive plastics strips. The adhesive strip also has a corresponding recess in the region of the through-flow opening.

A second elastic film may be arranged either directly on the first film, particularly flatly connected thereto, or advantageously the second film may be arranged on the opposite side of the through-flow hole. The second elastic film seals off the fluidic structure at the substrate. It preferably forms a side wall of a channel or rests on the substrate such that the through-flow opening is covered by the film. Preferably, the second film is only partly attached to the substrate, so that in unattached regions channels are formed between the substrate and the second film or can be formed by expansion of the film.

Instead of a container shaped by thermoplastic deformation of a rigid plastics material to form pouches, a flexible bag or tube may also be used as the container. A bag of this kind has a closure sealed with a first form. The bag or tube is arranged in the recess and at the same time the first film is sealingly connected to a through-flow opening or an inlet region of a microfluidic platform, particularly by adhesive bonding and welding.

The flexible bag may be compressed easily by the exertion of pressure. Preferably, the bag is arranged in a chamber which can be acted upon by compressive force via a valve or a connection. The compressive force acting from outside compresses the bag, thereby introducing the fluid into the microfluidic structures.

Furthermore, a pressing member, particularly a conical pin, may preferably be arranged on a microfluidic device thus formed, this pin being moveable in relation to the blister chambers or blister pouches. During the movement envisaged in the region of the base of the blister chamber the conical pin is pressed into the chamber and thus causes tearing or breakage of the first film, thereby opening a fluidic connection between the fluid channel in the blister and the capillary channel of the microfluidic platform.

In a preferred embodiment of the invention a plurality of pins are pressed into the blister so that a fluid path is opened up for a plurality of liquids from different containers, or a fluidic connection is provided for a particular solution from a number of entry points into the microfluidic network of the platform.

The metering of the solutions or reagents is carried out by compressing the container. Preferably, compression is carried out by exerting pressure on the container walls, e.g. by an operating person pressing their fingertip onto the outer surface of the container. An automated solution might be to compress the container chamber by means of a die and thereby force the fluid into the adjacent channels.

Preferably, a flat die of the size of the platform is moved a defined amount by an analysis instrument. By surface pressure on the container chambers which are raised geometrically above the surface of the microfluidic platform, the chambers are deformed and meter the fluid into the channel system of the platform.

In another preferred embodiment it is envisaged that a die be used, the die surface of which covers the surface of a container, the die being brought to bear on different containers one after the other by a displacement mechanism and thereby metering a sequence of fluids or reagents in defined manner into the microfluidic platform by lowering the die and compressing the containers. The adjusting mechanism or actuating drive may be a positioning slide controlled by the analysis device, which a step drive or a micromechanical actuator.

The analysis device is operated for example by an operator, whereby the operator initially connects a microfluidic platform, a cassette or cartridge with a blister strip according to the invention, by placing the blister strip on the platform, so that the blister strip and the platform rest with their flat sides facing one another. Then the analysis device is loaded with the microfluidic device thus formed and the analysis process is started.

Depending on the process steps of the analysis envisaged, there may be a need for interim reloading of the microfluidic platform with another blister. For this purpose, the microfluidic device which comprises the microfluidic platform and a blister is removed from the analysis device, the used blister is taken out and a new blister is placed on the platform and the device is fed back into the analysis device. Advantageously, these operating steps may also be performed automatically, e.g. by a laboratory robot which carries out the corresponding steps.

In a preferred embodiment, the microfluidic platform, i.e. the cassette or cartridge, is connected to containers according to the invention during the manufacturing process itself. For this purpose the platform has recesses in which a container is inserted with its opening side. The container is adhesively bonded or welded, for example, to the platform in the region of the recess.

In the region of the recess or cut-out the platform has an inlet region for a microfluidic channel so that after the severing of the film that closes off the container, the fluid enclosed in the container can flow into the channel. It is essential for the operation of the container in conjunction with the platform that there be a leak-tight coupling between the container and the inlet region for a microfluidic channel in the platform.

This coupling is advantageously provided by sealing means such as, for example, elastic seals which surround the inlet region.

Alternatively, such a coupling may also be provided by local adhesive bonding or welding which welds and sealingly connects the inlet region to the platform and the outlet region to the container. Particularly advantageously, the container and platform are adhesively bonded by a double-sided adhesive film material, whereby in regions of a flat fluidic coupling, openings are provided in the form of recesses in the adhesive film material. The adhesive film fixedly connects the containers to the platform and seals off the connecting region.

In a preferred embodiment, the analysis device contains a control device, particularly a process computer, which monitors and regulates the analysis steps being carried out by means of suitable control software. The control computer is connected to sensors and/or actuators that detect and implement the metering of the liquids or reagents from the containers.

Thus, the control device preferably contains at least one microprocessor or ASIC which detects sensor data through a D/A and/or A/D interface and sends control signals to the actuators, particularly actuating drives. Depending on the control signal, one or more pins or dies are then moved to pierce the first film and in another step one or more dies are moved to compress the containers and in this way one or more reagents are released in defined manner into the channels in the microfluidic platform.

The invention is explained with reference to the figures described below.

In the figures:

FIG. 1 shows a longitudinal section through a container according to the invention.

FIG. 2*a*-FIG. 2*e* show containers in plan view and in cross-section.

Figure 5A:
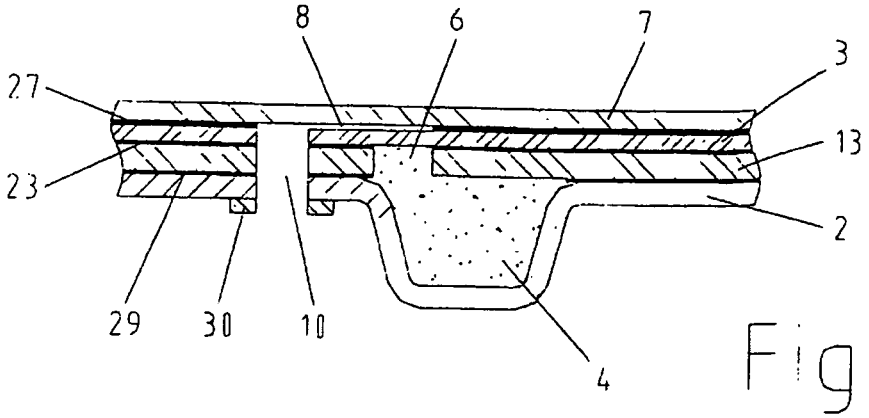
Figure 5B:
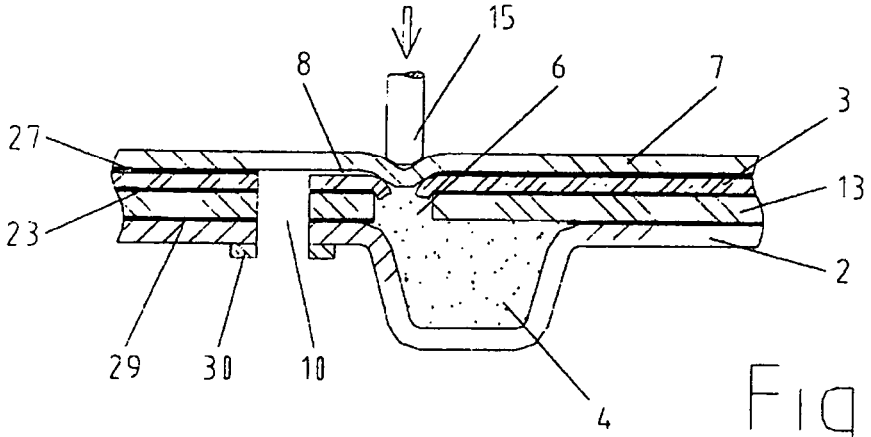
Figure 5C:
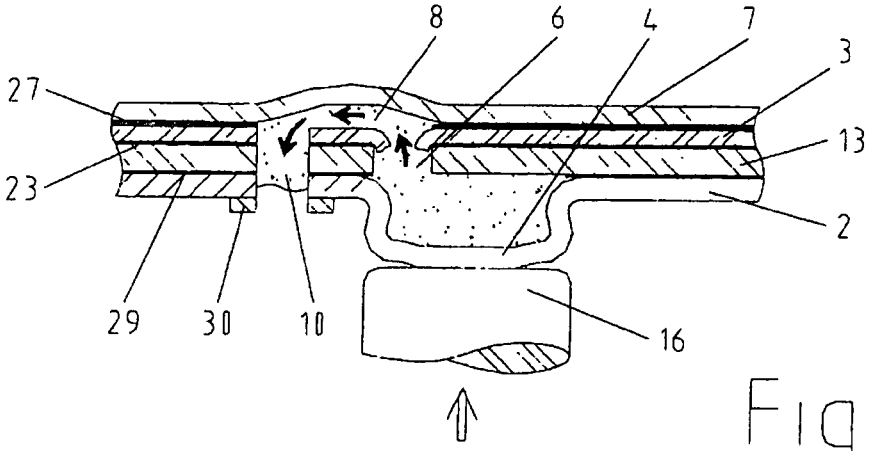

FIG. 5*a*-FIG. 5*c* show a container with an intermediate film and a constricted fluid channel.

Figure 6A:
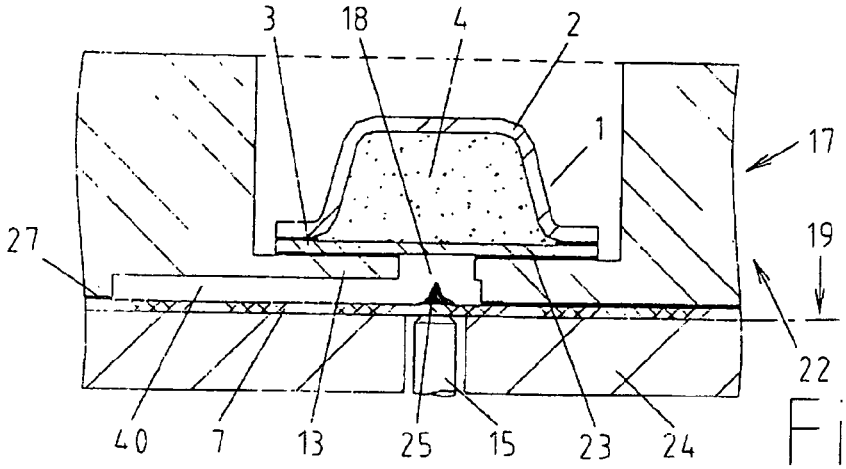
Figure 6B:
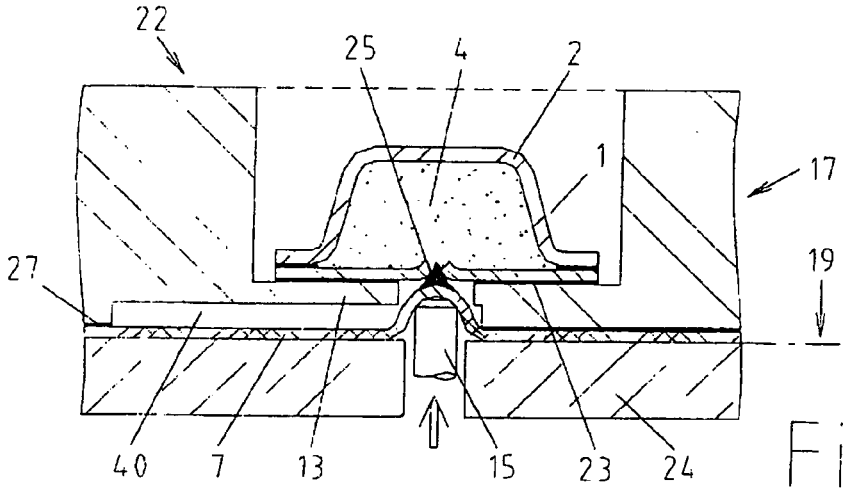
Figure 6C:
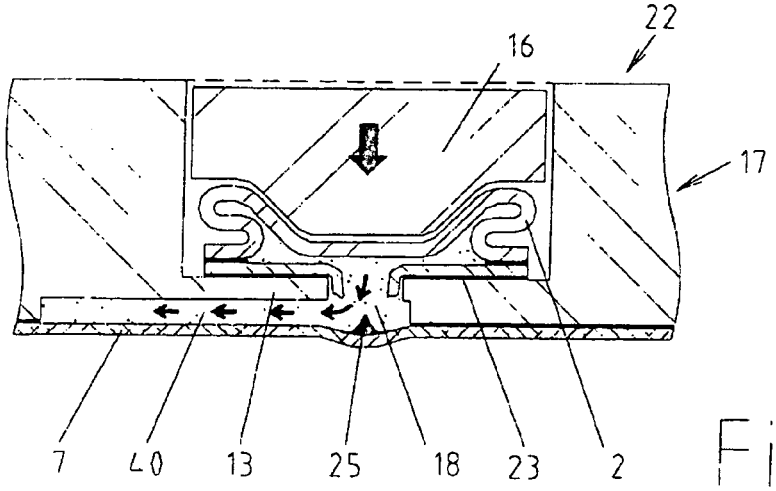

FIG. 6*a*-FIG. 6*c* show a microfluidic cartridge with an outlet channel.

Figure 7A:
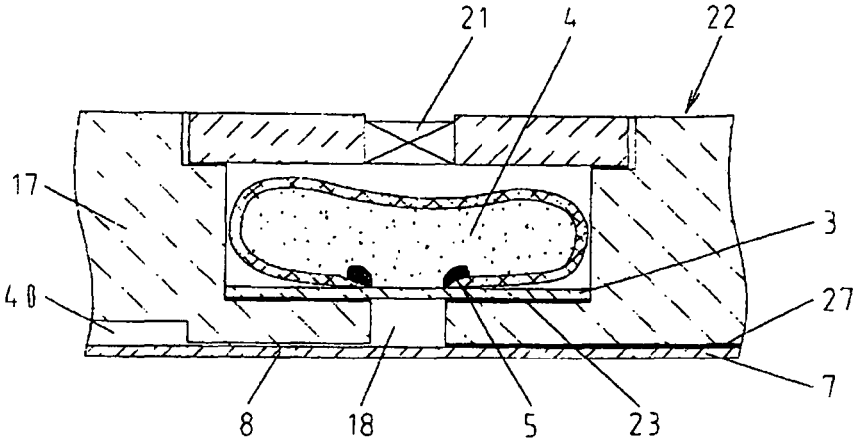
Figure 7B:
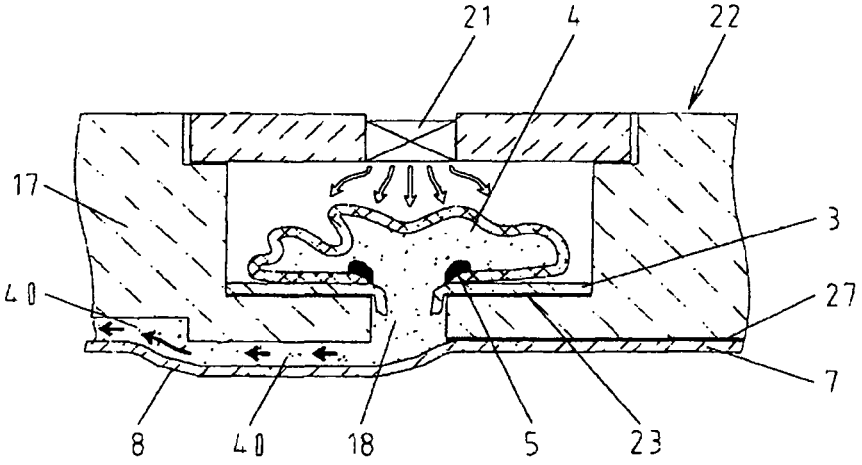

FIG. 7*a*-FIG. 7*b* show a microfluidic cartridge with a flexible container bag.

Figure 8:
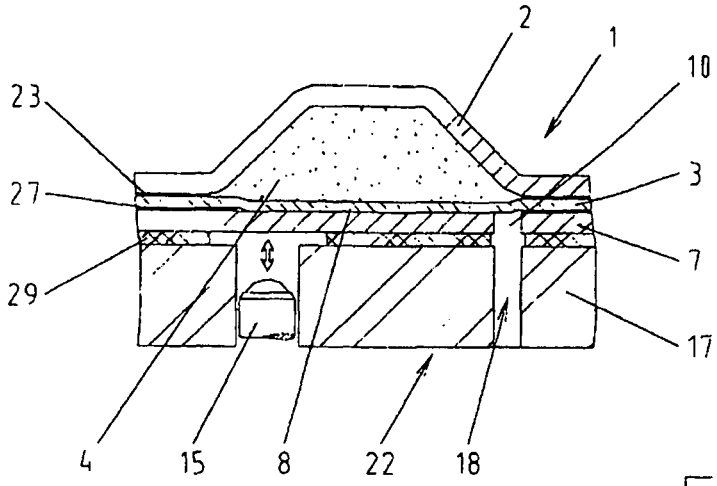

FIG. 8 shows a microfluidic cartridge with a partially unattached first film.

Figure 9:
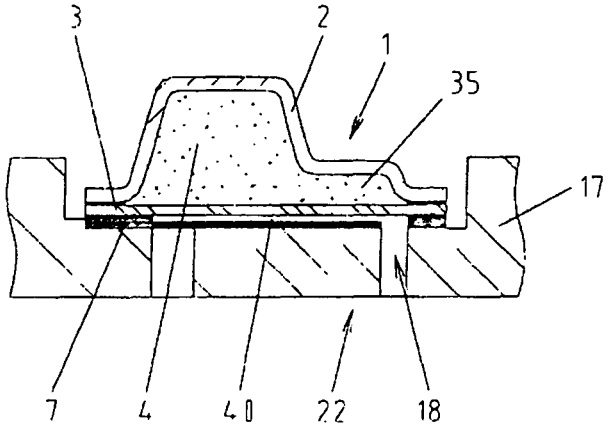

FIG. 9 shows a microfluidic cartridge with a container having an outlet region.

Figure 1:
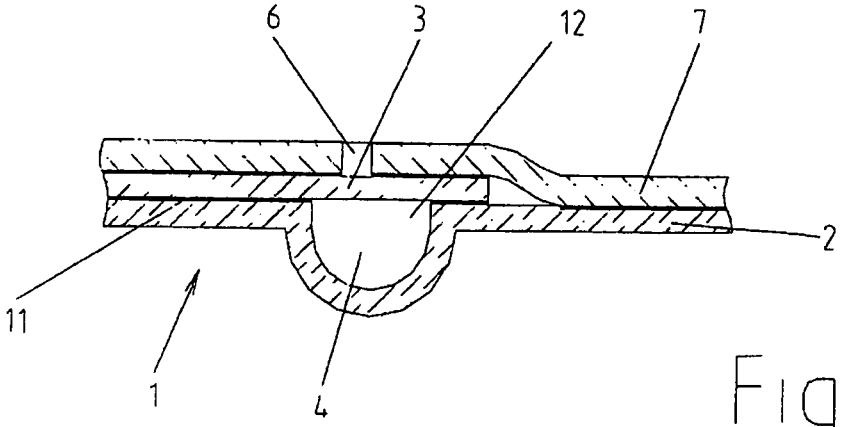

FIG. 1 shows a container (1) according to the invention, in which a second film (7) of elastic material covers the container base. The container is formed from a carrier strip, particularly a plastics strip (2) made of PP, in which pouches (4) have been formed by thermoforming. The container wall formed from the material has a thickness of 100 microns to 300 microns, preferably a thickness of 180 microns to 220 microns. The container pouch (4) has a volume of 100 microliters to 1000 microliters, according to the embodiments shown preferably 20 microliters to 400 microliters.

The indentation (4) is hemispherical and elastically deformable by pressure, particularly by finger pressure, particularly by finger pressure applied by an operator. Preferably, the plastics strip is laminated, lined or coated with a metal foil, particularly aluminium, so as to form pouches or indentations (4) that are diffusion-proof, gas-tight and fluid-tight.

A first film (3) covers the container opening in fluid-tight manner. The fluid-tight connection of the first film (3) is produced by welding the first film (3) along a first weld connection (11) to the container wall in the region of the container base. Alternatively, the first film may also be attached to the base (2) of the container formed by the flat region of the plastics strip, the attachment being effected by adhesively bonding the first film (3) to the plastics strip (2) along an adhesive joint. Advantageously, the first film (3) and the elastic second film (7) lie flat on top of one another.

The first film (3) is preferably made of metal, particularly aluminium, and closes off the container pouch in fluid-tight manner. The first film may be welded or adhesively bonded over its entire surface to the plastics strip (2). Preferably, according to embodiment 1 it is applied only in the region of the pouches. The first film is made sufficiently thin that it can be made to burst by a pressure of 0.5-25 Newtons, particularly by a low pressure of 3 to 10 Newtons, for example by the application of finger pressure.

The elastic second film (7) closes off the container base. Advantageously, it completely covers the base of the carrier strip (2) or blister strip. The second film is attached to the surface of the container, particularly the blister strip formed by the pouches and the sealing film, and particularly is adhesively bonded or welded by its surface to said blister strip and/or the first film (3).

In the present embodiment, a first through-flow opening (6) is provided in the region of the base opening (12) or the upwardly facing container opening (12). If pressure is then applied to the first film (3) and the second film (7) in the region of the container opening (12), the first film (3) bursts and the liquid contained in the container is able to escape from the container through the first through-flow opening (6).

In another embodiment according to FIG. 2*a*, FIG. 2*b*, FIG. 2*c*, FIG. 2*d* and FIG. 2*e*, a carrier (2) is shaped as in FIG. 1 so as to form pouches (4) for containers (1). The carrier material consists of an aluminium-plastics composite, the aluminium having been laminated on. A liquid, particularly a reagent is placed in the blister pouches (4), which form container chambers, during the manufacture of the container (4). A first film (3), preferably a metal foil, is connected to the edge of the container (9) by an adhesive bond (5), by lamination, adhesion, welding or other attachment methods, so that the first film (3) meets the edge of the container and closes off the container opening (12). The first film covers the flat surface all around the container or is applied only locally in the region of the container opening.

Another intermediate film (13) is arranged on the first film (3) and carrier strip (2), particularly connected flatly thereto. The intermediate film preferably consists of an elastic material that can be deformed by the exertion of pressure. The intermediate film (13) has a first through-flow opening (6) in the region of the container opening (12) which is arranged at a spacing of 1 mm to 10 mm from the edge (9) of the container chamber and which is formed as a hole or bore with an opening diameter of 100 microns to 5000 microns. The hole or the opening (6) faces towards the hemispherical pouch (4).

The intermediate film (13) is preferably elastic. However, it may also consist of an inelastic material, as in the other preferred embodiments according to FIGS. 2*c* to 2*e*. The intermediate film (13) is constructed in the region of the container opening (12) such that the latter has an encircling free space at the container edge (9). Thus the part of the surface of the intermediate film (13) at the container opening is not connected to the remainder of the intermediate film (13), as a result of which the piece of intermediate film at the container opening is freely moveable relative to the remainder of the intermediate film. Alternatively, spot connections between the pieces of intermediate film may be left in the encircling free space, these connections being broken when pressure is applied.

A second film (7) is connected to the intermediate film (13) by a flat attachment. The surface welding (11) or adhesive bonding (5) of the second film (7) is carried out such that in a region (8) extending from the pouch edge (9) to a second through-flow opening (10) there is no firm adhesion of the elastic second film (7) to the blister strip (2). The second elastic film (7) abuts in an elastically sealing manner in the unattached region (8). The through-flow opening (10) in the second film is congruent with a through-flow opening (10) in the carrier or blister strip (2).

Figure 2B:
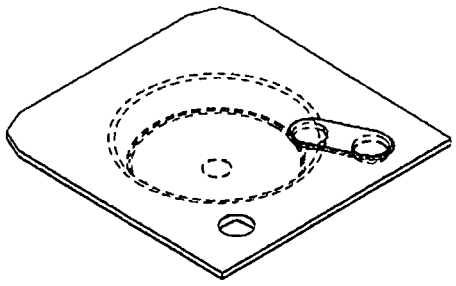
Figure 2C:
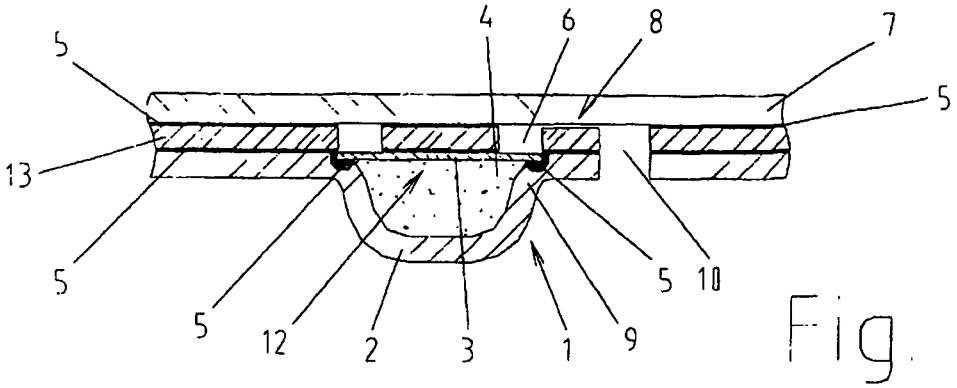
Figure 2D:
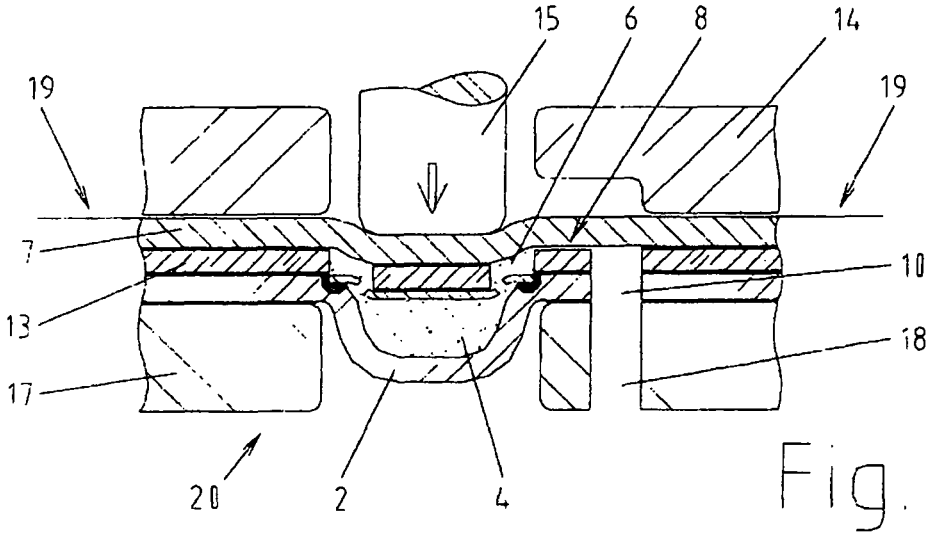
Figure 2E:
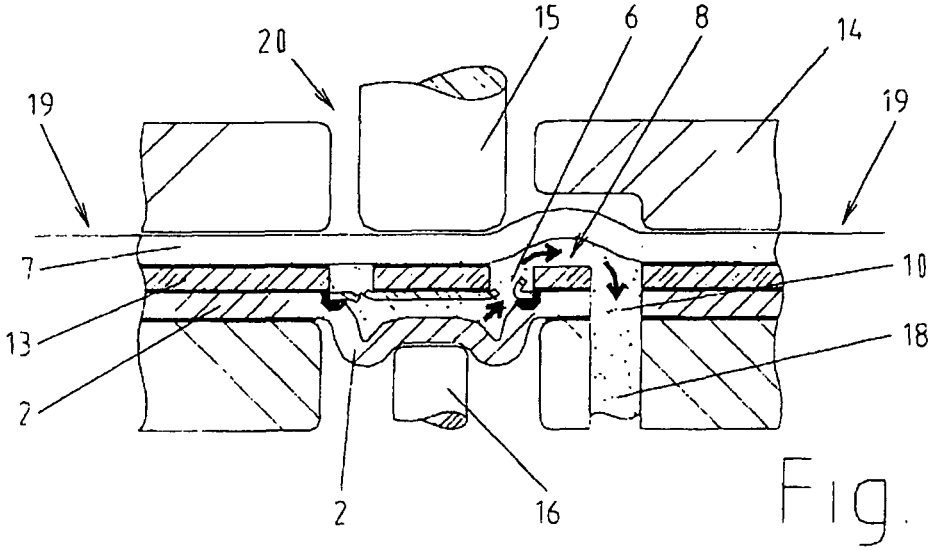

According to FIG. 2*c* and FIG. 2*e*, a container (1) is shown in a microfluidic device (20), this container being connected to a microfluidic platform (17). The platform (17) and the container (1), which may also be part of a blister strip, are held by a support (14). The microfluidic platform (17) has an inlet region (18) from which test fluids or reagents can flow into a fluidic network or a channel of the platform (17). Preferably the liquid is distributed in the microfluidic platform (17) by capillary force.

For releasing the liquid in the container (1) and metering the liquid into the microfluidic platform (17), a die or ram (15) is moved through an opening in the support (14) and initially rests with its flat cross-sectional surface on the second elastic outer film (7). If the travel of the die (15) then goes beyond the support plane (19) as shown in FIG. 2*d*, this plane being defined by the support (14) and the flat container side, the outer second film (7), the intermediate film (13) and the first film (3) are pressed towards the interior of the container. The outer second film (7) deforms elastically, the intermediate film (13) is moved substantially without any force and the first film (3) with low elongation at break tears in the region of the first through-flow opening (6). It is conceivable that an encircling tear will form in the region of the edge of the container.

In the next step, the first die (15) is moved back to the support plane (19), while as a result of the elasticity of the second film (7) the second film (7) returns to its position and the pressure that has been built up inside the container by the movement of the first die (15) is broken down again.

In the following step, as shown in FIG. 2*e*, a second die (16) is moved, to compress the dome-shaped container. The hydrostatic pressure forming forces the liquid out of the inside (4) of the container and flows through the opening (6) exposed. As a result of the elasticity of the second film (7), which abuts sealingly in the unattached region (8), the flow channel formed is initially still tightly sealed.

Above a certain pressure in the fluid, the restoring force of the second film (7) and its adhesion to the intermediate film (13) in the unattached region (8) is overcome, so that the fluid flows through the channel formed by the convexity of the film (7) in the unattached region (8). This channel path has the property of acting as a constriction for the flow, as the restoring forces of the film (7) cause a homogeneous entry of liquid into the channel.

This prevents bubbles from being produced at the entrance to the channel. Starting from the channel in the region (8), the liquid or the reagent then flows through the second opening (10) in the intermediate film and in the carrier (2) into the inlet region (18) of the microfluidic platform (17).

Figure 3:
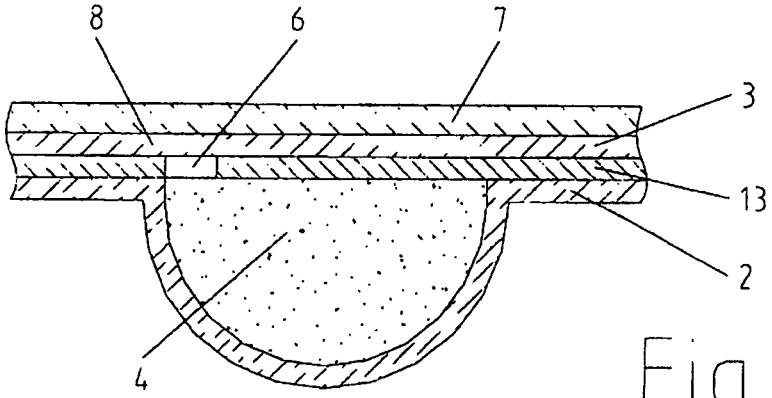
FIG. 3 shows an embodiment of the container with a plurality of sealing films.

According to FIG. 3 the films may also be layered differently relative to one another. Here, an intermediate film (13) is arranged directly on a carrier film (2), which forms a container (1) with a container chamber (4). The intermediate film (13) is covered by the first film (3) with low tear strength and the second film (7). Both the intermediate film (13) and the second film are elastic. The first film (3) is connected by its surface to the intermediate film (13), particularly by adhesive bonding.

The first film (3) is also adhesively bonded by its surface to the second film (7), leaving an unattached region (8). When a force is applied, the second outer film (7) and the intermediate film (13) deform elastically, while the first film tears. When a container chamber (4) of this kind is compressed, a channel forms between the first film (3) which is fixedly connected to the carrier (2) and the intermediate film (13), and the outer elastic film (7), through which the fluid can flow into an inlet region of a microfluidic device (20).

Figure 4A:
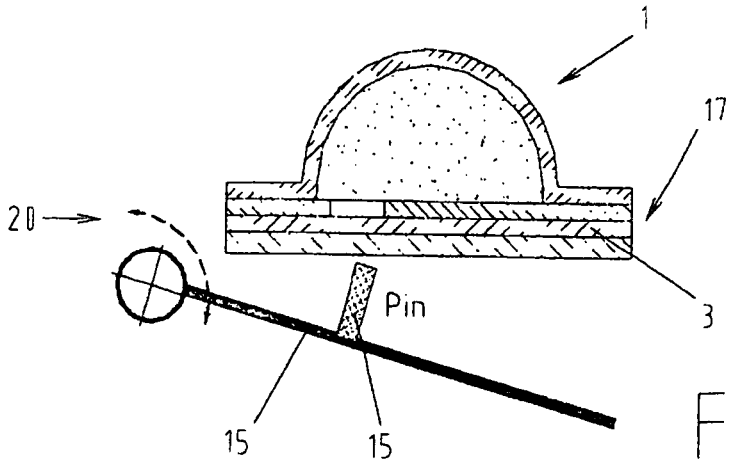
FIG. 4 shows a container with means for opening a channel to the container.
Figure 4B:
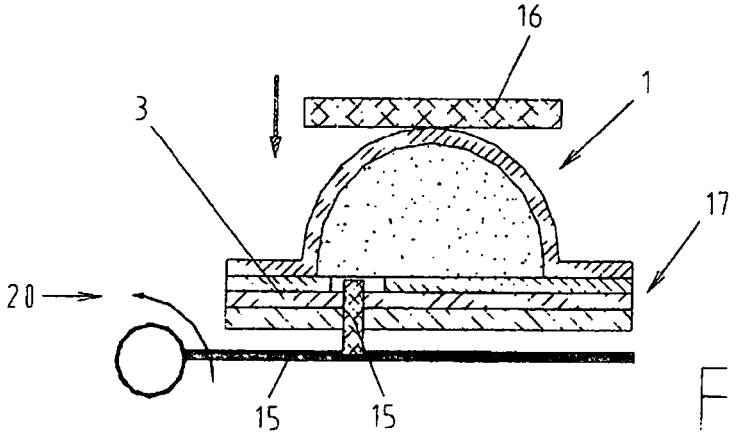
Figure 2A:
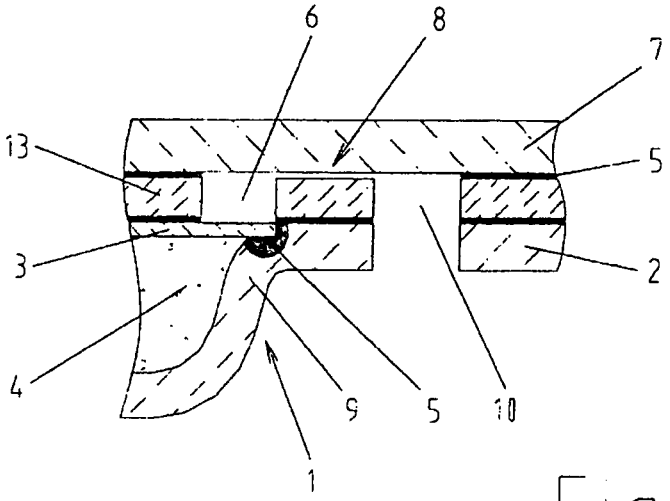

According to one embodiment of the invention shown in FIG. 4*a* and FIG. 4*b*, a microfluidic platform (17) with a blunt tool, a first die (15), is mounted on a moveable plate of an analysis device which is moveable about a centre of rotation of the analysis device in the instrument. The microfluidic analysis device is inserted with the mounted and completely full blister package in a microfluidic device (20).

The underside of the blister pack consists of a thin, flat aluminium foil (3) with an adhesive layer to the shaped aluminium composite film on the top. A mechanism in the analysis instrument moves the moveable plate with the blunt die tool (15), particularly conical die, mounted thereon, about the centre of rotation to the underside of the microfluidic platform (17) in the instrument. In doing so, the elastic film on the underside of the microfluidic platform (17) or blister is elastically deformed by the blunt tool without being destroyed. The thin aluminium foil of the blister pack arranged above it, at a greater or lesser spacing from the underside of the microfluidic platform (17), is broken by the blunt tool, so that the liquid enclosed inside the container can escape and reach the microfluidic platform (17).

Because of the deformed but not destroyed elastic film on the underside of the microfluidic platform (17) or of the blister, the microfluidic platform (17) remains closed and sealed, so that there is no risk of contamination of the analysis instrument. A die tool (16) in the device causes the shaped top of the blister pack to be deformed by the instrument in controlled manner after the opening of the blister pack and the measuring fluid is transferred in controlled manner onto the microfluidic platform (17).

FIGS. 5*a* to 5*c* show another advantageous embodiment of a container (1) according to the invention. The container comprises a container chamber (4) in a substrate strip (2). The container (1) opens towards a plate-shaped plane of the substrate strip (2). Projecting from the plane is the conical container (1), while a blister strip may have a plurality of such container chambers (4) or pouches. An intermediate film (13) is laminated onto the base plane of the container (1) or blister strip.

The intermediate film (13) has a first through-flow opening (6) in the region of the container chamber (4), and moreover a second through-flow opening (10) in the form of a through-hole is provided in the intermediate film (13), which is congruent with an opening in the carrier strip (2).

On the second opening a sealing means (30), particularly a double-sided adhesive seal (30) with a through-flow opening is provided, so that a fluid-tight connection between the container (1) and an inlet region of a fluidic device can be produced through the seal (30).

A third attachment (29) is formed by laminating the first film onto the flat container surface. This laminate connection (29) forms a fluid-type barrier layer between the intermediate film (13) and the carrier (2), so that it is only possible for fluid to enter the interior (4) of the chamber of the container through the first (6) and second through-flow opening (10).

A first, preferably fluid- and gas-tight aluminium foil (3) is laminated onto the intermediate film. The first foil or film also has an opening in the region of the second through-flow opening (10), which is preferably congruent to the openings in the carrier (2) and the intermediate film (13).

The lamination forms a second attachment (27) in the form of an adhesive layer or weld which joins the intermediate film (13) to the first film in fluid-tight manner over its entire surface, with the exception of the through-flow openings (6, 10).

As an alternative to the lamination of the intermediate film (13) with the container carrier (2) and the first film (3), a double-sided adhesive intermediate film (13) may be provided. A second film (7) is laminated onto the first film (3), the lamination being carried out once again over the entire surface, with the exception of unattached channel regions (8) which connect the first through-flow opening (6) to the second through-flow opening (10). The lamination forms a first attachment (23). As can be seen in FIG. 5*a*, an intermediate gap may be produced which forms the channel, or the outer film (7), in contrast to the representation in FIG. 5*a*, abuts sealingly on the first film (3) and the second through-flow opening (10).

The second elastic film (7) and the first film (3) differ in their tear strength such that when pressure is applied the first film tears and the second film (6) is deformed elastically and/or plastically.

For severing the first film (6), the sealing film for the container (1), a first die (15), the separating die, is moved in the direction of the first through-flow opening (6). The separating die (15) has a blunt die surface and is of dimensions such that it is able to enter the opening (6). The first film (3) thus tears as shown in FIG. 5*b*. Preferably, the blister chamber (4) is completely full. If the separating die (15) is now retracted, the second film (7) returns approximately to its initial position as a result of its elasticity.

In another step, during the use of the container (1) in a cartridge (20), a second die (16) acts on the container. The container, which is held by a cartridge (20), is compressed by the pressing die (16) thus forcing the fluid out of the container.

The fluid pressure that builds up leads to an expansion of the second film (7) in the unattached region (8) so that a fluid channel is formed through which the container fluid flows out.

As a result of the storing force of the second film (7) of the outer covering film of the container (1), the walls of this fluid channel bounded by the film act as a constriction and lead to a homogeneous flow of fluid in the channel. In particular, the constricting effect suppresses the in-flow of air bubbles, as turbulence is avoided. In a preferred embodiment, the outer elastic covering film (7) is a double-sided adhesive film. On one adhesive side the adhesive film (7) may be attached to the sealing film (3).

The second outer adhesive side of the adhesive film (7) then serves to attach the container (1), or in the case of a plurality of containers the blister strip to a microfluidic transparent device, particularly to adhesively bond or weld it to a microfluidic cartridge.

In another embodiment according to FIG. 6*a*, a microfluidic platform (17) consists of a plate-shaped substrate with recesses which have inlet openings (18) for a microfluidic network. The recesses are formed in a first side, e.g. the top of the substrate, and may partially or wholly accommodate a container (1). On the underside of the substrate, microfluidic structures are formed in the substrate, particularly recesses in the form of channels or chambers. The inlet opening (18) is connected to the structures in a manner open to fluids, so that reagents entering the inlet opening (18) flow into the microfluidic network.

A channel (40) is directly adjacent to the inlet opening (18).

An elastic second covering film (7) is laminated onto the underside of the substrate along a fixing layer (27) and thereby closes off the microfluidic structures in fluid-tight manner. A container (1) having a first sealing film (3) which encapsulates the container chamber (4) in fluid- and gas-tight manner is attached via the outer film surface in the recess.

The sealing film that forms the basis of the container is adhesively bonded along a first attachment layer (23) and thus seals off the inlet opening (18) in fluid-tight manner from the top.

The cartridge (22) formed by the microfluidic platform (17) and the container (1) attached thereto abuts along a plane (19) on a receptacle (24) of an analysis device. The receptacle (24) comprises a through-bore in registry with the inlet opening (18). A separating die (15) is guided within the bore and moves in the direction of the inlet opening (18). The flexible elastic second film (7) is pressed through the inlet opening until it abuts on the first film. As the first film has only limited elongation at break or tear strength, further movement causes the first film to break.

The travel distances are exaggerated in the figures. Typically, the height of the channel (40) is 10 microns to 100 microns and the thickness of the substrate carrier in the region of the inlet opening (18) is 100 microns to 5 mm. The actuating distance of the first die (15) results in a stroke of from 200 microns to about 5 mm.

The separating die has a diameter of 1 mm to 10 mm, the diameter corresponding to the diameter of the inlet opening (18).

The separating die may be automatically moved by suitable actuators, e.g. by piezoelectric drives. Advantageously, a separating wedge (25) may be provided on the second film (7) in the region of the inlet opening in order to assist the separating process. This separating wedge serves for the introduction of force at a point and separation of the sealing film (3). The separating wedge (25) preferably consists of the same material as the second film (7) or alternatively is made from an inelastic material and is subsequently attached to the first film (7).

When the cartridge (22) is inserted the separating die (15) is retracted. The elastic covering film (7) resumes its original position, approximately. Now, as shown in FIG. 6*c*, a pressing die (16) is placed on the dome-shaped container (1). The diameter of the pressing die (16) roughly corresponds to the diameter of the recess in the platform (17), so that it can be lowered into the recess.

Advantageously, the die (16) has a flattened conical tip. The flat top of the spherical section rests on the container base and presses the contents of the container through the inlet opening (18) into the channel (40) or a channel system.

The container wall then folds. The conical tip of the die (16) has a smaller base area than the surface of the die, so that the folded container wall is laid against the outer diameter of the die (16) in an edge region.

As a result it is possible to compress the container to a greater extent and expel the liquid contained therein completely into the platform (17).

In another embodiment according to FIG. 7*a*, the cartridge (22) comprises a microfluidic platform (17) with a carrier substrate in which a recess is formed, an elastic covering film (7) which sealingly covers a channel (40) and an inlet opening (18). The covering film (7) is attached over its surface to the substrate, particularly laminated onto the substrate, while unattached regions (8) provide a fluid connection between through-flow openings (18) in the substrate and microfluidic structures (40).

The inlet opening (18) is covered in the recess by a sealing film (3) which is fixedly attached to the substrate in fluid and gas-tight manner by means of an attachment layer (23), particularly an adhesive or weld line.

In the recess, a flexible bag is provided as the container (1), the closure of the container being formed by the sealing film.

The closure may have a collar-shaped through-flow region (not shown here) to which the sealing film is attached by gluing.

The recess is sealed off in gas-tight manner by a cover with a valve or alternatively with a gas opening. The cover is welded to the substrate, for example. A gas can then be introduced under elevated pressure through the connection or the valve (21).

If the sealing film (3) is then severed, as described previously, the flexible bag is compressed by the gas pressure and the fluid it contains flows into the channel (40) as shown in FIG. 7*b*. In this embodiment too, the length of channel has constricting effect in the unattached region (8).

A cartridge (22) according to FIG. 8 comprises a container (1) consisting of a pot-shaped carrier strip (2) which has been laminated to a lined aluminium film along a first attachment plane (23). The lining or lamination of the aluminium foil (3) has been carried out in a previous operation, in which an elastic film (7) with a through-flow opening (10) is attached over its entire surface to the aluminium foil, with the exception of channel-shaped regions (8). The cartridge (22) further comprises a microfluidic platform (17) with inlet openings (18) for fluid-conveying structures in the platform (17) and with openings for guiding a separating die (15).

The platform (17) is attached to the container (1) via a fastening layer (29), such as an adhesive layer, a weld connection or a double-sided adhesive strip (29).

In an embodiment according to FIG. 9 the cartridge (22) comprises a container (1) which is closed off by a sealing film (3) made of aluminium and has been inserted in a recess in a platform (17).

The container (1) and platform (17) are joined together via an elastic covering film (7) which has a channel (40) that opens into an inlet region (18) of the platform. The covering film (7) is sticky on both sides, so that the bond is formed by adhesion. Advantageously, the container has a channel (35) which extends over the channel (40) and prescribes a preferential direction for the flow of fluid.

LIST OF REFERENCE NUMERALS

1—container
2—carrier strip
3—first film
4—container chamber
5—adhesive bond
6—first through-flow opening
7—second film
8—unattached region
9—edge of container
10—second through-flow opening
11—weld connection
12—container opening
13—intermediate film
14—support
15—first die
16—second die
17—microfluidic platform
18—inlet opening
19—support plane
20—microfluidic device
21—valve
22—cartridge
23—first attachment
24—receptacle

25—separating part
27—second attachment
29—third attachment
30—channel
35—container channel
40—channel

The invention claimed is:

1. A microfluidic cartridge (22) for metering a liquid into a channel, comprising:

a plate shaped substrate (17) which has a through-flow opening (18), a chamber (4) tightly sealed by a first film (3), the first film (3) being arranged at a first side of the through-flow opening (18), and wherein the chamber (4) is formed by a container (1) which is encapsulated by the first film (3) and whereby the container (1) is attached via a surface of the first film (3) to the substrate (17), and a second film (7) arranged at a second, opposite, side of the through-flow opening (18), wherein the second film (7) forms a channel (40) with the substrate (17) and the first and second films differ in respective tear strength such that when pressure is applied simultaneously to both the first and second films, the first film (3) tears while the second film (7) deforms elastically and/or plastically.

2. The microfluidic cartridge (22) according to claim 1, wherein the chamber (4) is an indentation in a carrier film (2).

3. The microfluidic cartridge (22) according to claim 1, wherein the channel (40) adjoins the chamber (4) and the first film (3) forms a fluidic separation between the chamber (4) and the channel.

4. The microfluidic cartridge (22) according to claim 1, wherein the first film (3) is a metal foil.

5. The microfluidic cartridge (22) according to claim 1, wherein the first film (3) consists of a plastic with an elongation at break of <50%.

6. The microfluidic cartridge (22) according to claim 1, wherein the first film (3) has a thickness of one of: (i) 5 to 100 microns, and (ii) 15 to 100 microns.

7. The microfluidic cartridge (1) according to claim 1, wherein the second film (7) is formed of an elastic material with an elongation at break of one of: (i) 300-2000%, (ii) 300-700%, and (iii) 400-600%.

8. The microfluidic cartridge (22) according to claim 1, wherein the second film (7) is formed of rubber.

9. The microfluidic cartridge (22) according to claim 1, wherein the second film (7) is formed of a material selected from the group consisting of: TPE (Thermoplastic elastomer), silicon, viton, and PVC.

10. The microfluidic cartridge (22) according to claim 1, wherein the chamber (4) is a depression in a blister pack (2).

11. The microfluidic cartridge (22) according to claim 10, wherein the wall of the chamber (4) consists of plastics and/or metal.

12. The microfluidic cartridge (22) according to claim 10, wherein the chamber (4) is tub-shaped or ellipsoid depression, wherein a pressure can be built up by pressing on the outer surface by deforming the chamber walls in the chamber (4).

13. The microfluidic cartridge (21) according to claim 1, wherein the through-flow opening (18) is fluidically connected to the channel (40).

14. The microfluidic cartridge (22) according to claim 13, wherein the channel (40) is formed by a recess in the substrate (17) and the second film (7).

15. The microfluidic cartridge (22) according to claim 1, wherein the substrate (17) includes a recess on an opposite side of the substrate (17) from the through-flow opening (18) and the container (1) is disposed within the recess.

16. The microfluidic cartridge (22) of according to claim 1, wherein the plate-shaped substrate (17) includes a network of channels therein, wherein, by arranging the substrate relative to the container (1), the through flow opening (18) is brought into fluidic connection with the container (1).

17. The microfluidic cartridge (22) according to claim 1, further comprising an impressing member which is moveable relative to the first and second films (3, 7) and includes a pin (15), wherein when the pin (15) is pressed into the first and second films (3, 7) a fluidic connection is created between a the channel (40) and the chamber (4).

18. The microfluidic cartridge (22) according to claim 17, further comprising an actuator which is moved by a motor drive to press the pin (15).

19. The microfluidic cartridge (22) according to claim 1, further comprising a moveable die (16) arranged relative to the chamber (4), wherein the die (16) operates to deform the chamber walls and compress the spherical chamber (4) such that the liquid is metered into the channel (40).

* * * * *